US006120340A

United States Patent [19]

Zaborowski

[11] Patent Number: 6,120,340

[45] Date of Patent: Sep. 19, 2000

[54] ANIMAL TOY WITH ALTERNATELY ATTACHABLE HAIRPIECE

[76] Inventor: Avis S. Zaborowski, 3433 Tallywood La., Sarasota, Fla. 34237

[21] Appl. No.: 09/343,740

[22] Filed: Jun. 30, 1999

[51] Int. Cl.[7] ..... A63H 3/16; A63H 3/02; A63H 3/44; A63H 3/00

[52] U.S. Cl. ..... 446/100; 446/372; 446/369; 446/394; 446/73

[58] Field of Search ..... 446/372, 394, 446/369, 390, 321, 337, 339, 295, 296, 97, 268, 100; 434/236, 366, 262, 270

[56] References Cited

U.S. PATENT DOCUMENTS

| | | | |
|---|---|---|---|
| 4,070,790 | 1/1978 | Strongin . | |
| 4,122,628 | 10/1978 | Crowell et al. | 446/100 |
| 4,729,751 | 3/1988 | Schiavo et al. | 446/268 |
| 4,874,345 | 10/1989 | Dirks . | |
| 5,041,050 | 8/1991 | Ritchey et al. . | |
| 5,129,853 | 7/1992 | Bowling . | |
| 5,232,369 | 8/1993 | Mavrikis . | |
| 5,807,155 | 9/1998 | Divvleeon | 446/369 |

*Primary Examiner*—Kien T. Nguyen
*Assistant Examiner*—Urszula M. Cegielnik
*Attorney, Agent, or Firm*—Charles J. Prescott

[57] ABSTRACT

A stuffed animal toy and a removable head covering accessory such as a hairpiece, a wig or a hat. The toy includes a body simulating an animal having a torso, legs and a head. The head covering accessory is removably attachable to the head and to at least one additional attaching area of the body whereby a person with an illness resulting in loss of hair can emotionally identify and relate to the toy by alternate attachment of the head covering accessory to either atop the head in a normal in-use position or to the body in a carried position. The preferred additional attaching area is a paw area of one leg to simulate carrying or holding of a hairpiece or wig by the toy, the hairpiece or wig being the preferred embodiment of the head covering accessory.

1 Claim, 2 Drawing Sheets

ANIMAL TOY WITH ALTERNATELY ATTACHABLE HAIRPIECE

BACKGROUND OF THE INVENTION

1. Scope of Invention

This invention relates generally to animal toys, and particularly to an animal toy with a simulated hair loss condition due to treatment for cancer and a removable hairpiece.

2. Prior Art

Numerous prior art teachings are directed to releasably attachable hairpieces for dolls and simulated figurines of both humans and animals. One such disclosure is found in U.S. Pat. No. 4,070,790 by Strongin which teaches a doll with releasably attachable hairpieces. The interconnecting structure which facilitates the interchangeable hairpieces appears to be the primary essence of this invention. Another doll head and detachable wig is disclosed by Ritchey in U.S. Pat. No. 5,041,050. This patent also discloses a unique interconnecting structure between a doll head and the wig to be more realistic while using an interchangeable structure. Still another such patented arrangement is shown in U.S. Pat. No. 4,874,345 invented by Dirks showing a doll head and hairpiece which is made releasably connectable by an enlarged suction cup.

Along the lines of the present invention, Mavrikis in U.S. Pat. No. 5,232,369 teaches a handicapped doll with removable limbs and a wheelchair so that a handicapped person may identify with and relate to the handicapped doll on an emotionally therapeutic basis.

A play animal having a changeable and cuttable fur arrangement is shown in U.S. Pat. No. 5,129,853 invented by Bowling. The body of the toy animal, preferably in the form of a dog, has a body covered by a removable coat of long fur which can be cut and groomed then removed and replaced with another fur coat for further cutting to give a different appearance.

The present invention provides a stuffed animal toy, preferably in the form of a teddy bear, having a releasably attachable hairpiece, wig, or other head covering accessory such as a hat which is alternately attachable to a body part of the animal toy. By providing an alternate body area attachment point for the hairpiece such as preferably the paw of one front leg, a psychologically therapeutic effect is afforded to a person having been treated for cancer or whom has otherwise become at least partially balded due to illness.

BRIEF SUMMARY OF THE INVENTION

This invention is directed to a stuffed animal toy and a removable head covering accessory such as a hairpiece, a wig or a hat. The toy includes a body simulating an animal having a torso, legs and a head. The head covering accessory is removably attachable to the head and to at least one additional attaching area of the body whereby a person with an illness resulting in loss of hair can emotionally identify and relate to the toy by alternate attachment of the head covering accessory to either atop the head in a normal in-use position or to the body in a carried position. The preferred additional attaching area is a paw area of one leg to simulate carrying or holding of a hairpiece or wig by the toy, the hairpiece or wig being the preferred embodiment of the head covering accessory.

It is therefore an object of this invention to provide an animal toy having a removable hairpiece which is releasably attachable either atop the head or to a body part such as a paw or torso to simulate carrying of the hairpiece when removed.

It is another object of this invention to provide an animal toy with a releasably attachable head covering accessory and alternate releasable attaching points, including atop the head of the animal toy, whereby a person with an illness resulting in the loss of hair can therapeutically identify and relate to the toy.

In accordance with these and other objects which will become apparent hereinafter, the instant invention will now be described with reference to the accompanying drawings.

DETAILED DESCRIPTION OF THE INVENTION

Figure 1:
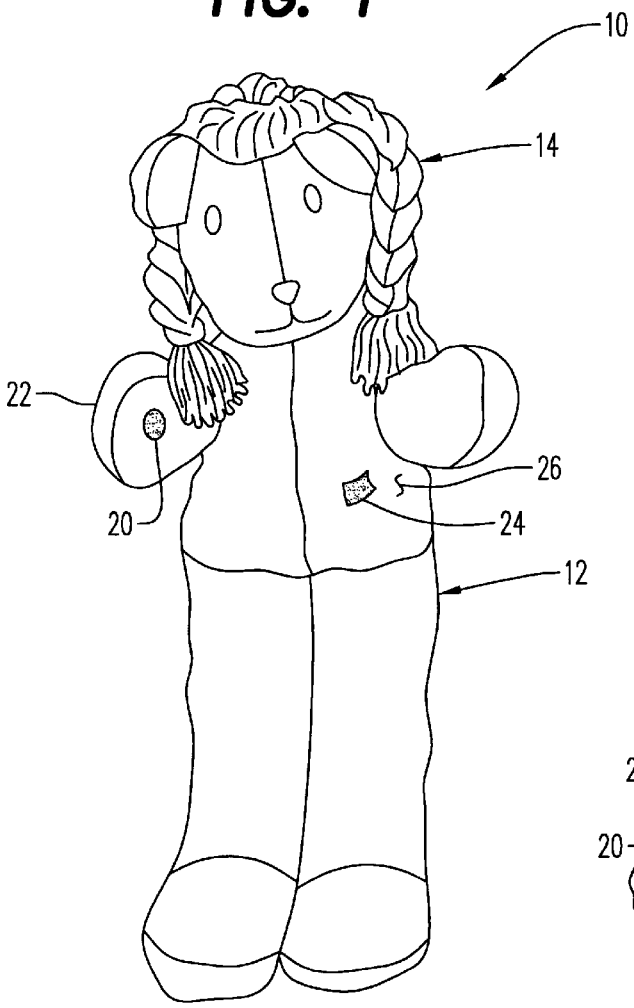
FIG. 1 is a perspective view of the preferred embodiment of the invention with the releasably attachable hairpiece shown in an in-use position atop the head of the animal toy.
Figure 2:
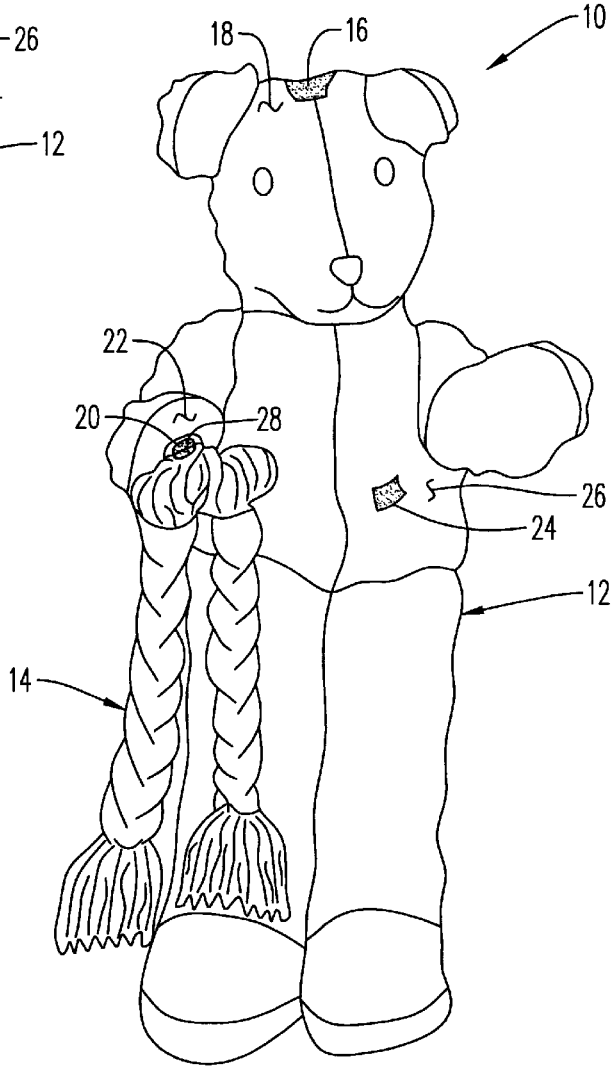
FIG. 2 is a view similar to FIG. 1 showing the hairpiece releasably attached to the paw of one front leg of the animal toy.

Referring now to the drawings, the preferred embodiment of the invention is shown generally at numeral 10 in FIGS. 1 and 2. The hairpiece 14 of FIGS. 1 and 2 is shown enlarged and in detail in FIG. 3. The stuffed toy animal shown generally at numeral 10 includes a body 12 and the releasably attachable hairpiece 14. The body 12 includes a torso, legs and a head, the preferred embodiment of the animal toy 10 being that of a teddy-type bear.

Figure 3:
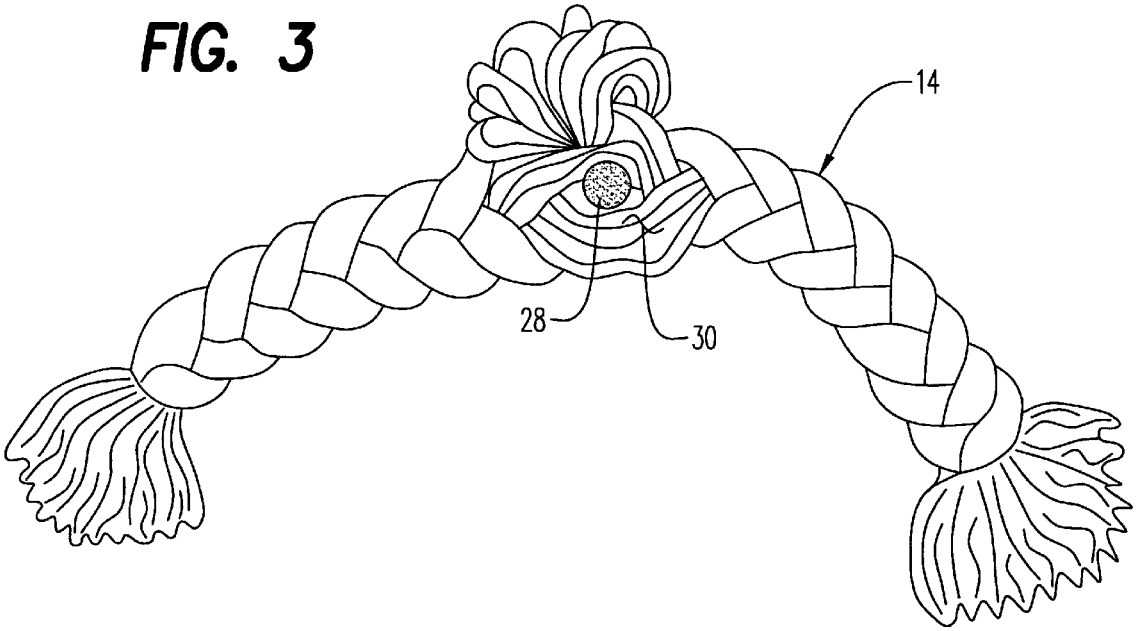
FIG. 3 is an enlarged perspective view of the removable hairpiece of FIGS. 1 and 2.

The hairpiece 14 as best seen in FIG. 3, includes a first attaching area or patch 28 which is one portion of a well-known two-part releasable attaching arrangement such as VELCRO. This first attachment area 28 is attached to the bottom central surface 30 of the hairpiece 14. A second attaching area 16 is releasably connectable to the first attaching area 28 and is connected centrally atop the head 18 of the body 12 as best seen in FIG. 2. By this arrangement, the wig 14 is made releasably attachable in an in-use position atop the head as shown in FIG. 1.

At least one additional attaching area 20 is attached preferably to a paw area of a front leg 22 of the body 12. By this arrangement, the hairpiece 14, being removed from atop the head, and having its first releasable attaching surface 28 attached to attaching area 20, provides the appearance that the animal toy 12 is holding or carrying the hairpiece 14 with the bare top of the head 18 exposed as would a person having suffered hair loss due to medical treatments such as that utilized for the treatment of cancer.

By the arrangement shown in FIGS. 1 to 3, such a person having suffered the loss of hair due to illness, can receive psychologically therapeutic benefit and can identify with, and relate to, the toy animal 10.

Although the preferred alternate placement of releasable attachment of the hairpiece 14 is as above described simulating carrying of the hairpiece, an attaching area 24 attached to the torso 26 of the animal toy 12, is also provided. This alternate releasable attachment of the hairpiece to this attaching area 24 provides an alternate physical appearance and positioning associated with the carrying of the hairpiece 14 when it is not in its in-use position atop the head 18 of the body 12. Moreover, other modes of effecting releasable attachment such as snaps are envisioned to be within the scope of this invention.

Figure 4:
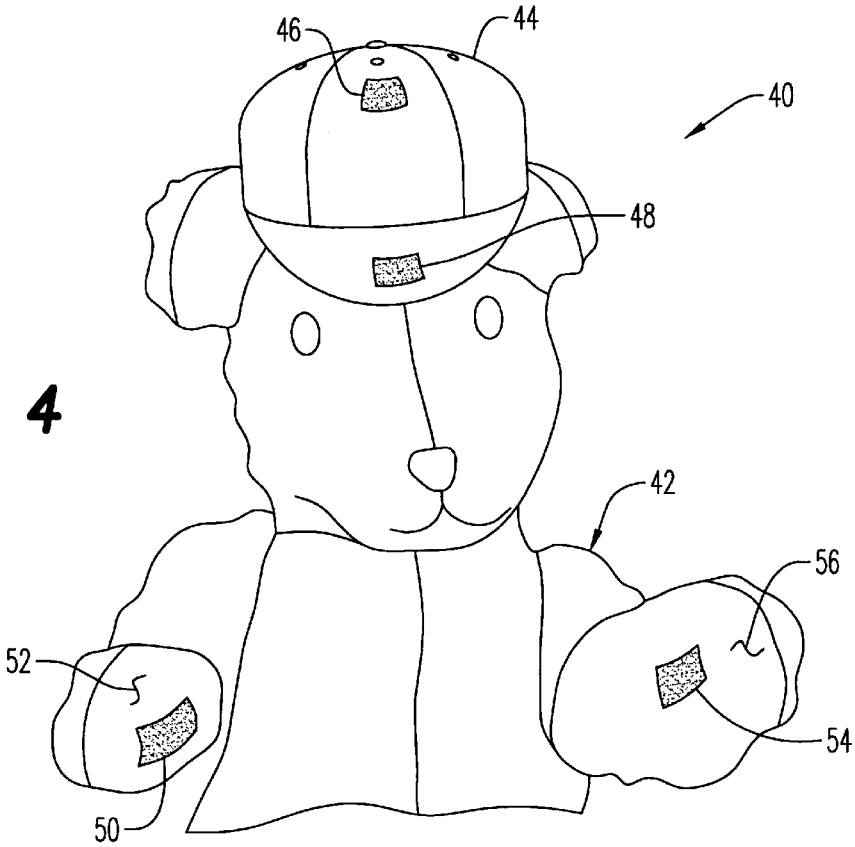
FIG. 4 is a perspective view of an upper body portion of another embodiment of the invention.

Referring now to FIG. 4, an alternate embodiment of the invention is there shown generally at numeral 40. This embodiment 40 also includes a body 42 with a torso, legs and a head, preferably in the form of a stuffed teddy bear. This embodiment 40 includes a releasably attachable cap or hat 44 which is made releasably attachable as previously described by a mating two part hook and loop arrangement (not shown) between the top of the head and the inner surface of the hat 44.

When removed from the head, the hat 44 is made attachable to a paw 52 of a front leg of the body 42 by providing attaching areas 46 and 48 connected to the outer surface of the hat 44 as shown, or by the attaching area (not shown) on the inner surface of the hat 44, each of which is releasably attachable to a mating attaching area 50 of the two-part releasably attachable type arrangement above described. An additional attaching area 54 of the other paw 56 of the body 42 is also provided. Again, a psychologically therapeutic benefit can be derived by a person with an illness which has resulted in the loss of hair who can identify and relate to this animal toy 40 by effecting and observing the alternate releasable attachment of the cap 44 either atop the head in an in-use position or in a carried position attached to either of the front paw areas 52 and 56 of the body 42.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In combination, a stuffed animal toy having a body simulating an animal, said body having a torso, legs and a head and a removable hairpiece, said combination acting as a therapeutic aid for a recovering cancer treatment person, said hairpiece consisting of:

a simulated hairpiece removably attachable only atop said head and to a distal paw area of one said leg whereby the person having received treatment for cancer resulting in loss of hair can therapeutically identify and relate emotionally to said toy by alternate attachment of said hairpiece to either atop said head in a normal in-use position for said hairpiece or to said paw area in a carried position.

* * * * *